US005127840A

United States Patent [19]

Bezusko et al.

[11] Patent Number: 5,127,840

[45] Date of Patent: Jul. 7, 1992

[54] SPARK PLUG CONNECTOR

[75] Inventors: Michael J. Bezusko, Warren; Kenneth B. Germ, Niles, both of Ohio

[73] Assignee: General Motors Corporation, Detroit, Mich.

[21] Appl. No.: 751,924

[22] Filed: Sep. 3, 1991

[51] Int. Cl.[5] ..... H01R 13/533

[52] U.S. Cl. ..... 439/127; 123/169 PH

[58] Field of Search ..... 439/125, 127, 128, 893; 123/169 EB, 169 PA, 169 PH

[56] References Cited

U.S. PATENT DOCUMENTS

| | | | |
|---|---|---|---|
| 2,398,359 | 4/1946 | Curtiss | 439/127 |
| 2,904,769 | 9/1959 | Sampson et al. | 339/26 |
| 2,943,139 | 6/1960 | Skunda | 174/77 |
| 3,050,658 | 8/1962 | Lay et al. | 315/83 |
| 3,359,526 | 12/1967 | Bakker | 339/26 |
| 4,715,337 | 12/1987 | Bohl et al. | 439/125 X |
| 4,906,202 | 3/1990 | Germ | 439/127 |

FOREIGN PATENT DOCUMENTS

| | | | |
|---|---|---|---|
| 817034 | 7/1957 | United Kingdom | 439/125 |

*Primary Examiner*—Eugene F. Desmond

*Attorney, Agent, or Firm*—Francis J. Fodale

[57] ABSTRACT

A spark plug connector for connecting an ignition cable to a recessed contact button of a spark plug comprises a boot assembly and a terminal assembly. The boot assembly includes a thermoplastic tubular boot that has an internal suspended terminal support tube and an external arm for securing the spark plug connector to an engine head. The boot assembly also includes an insert molded elastomeric seal that provides spark plug and ignition cable seals at the respective ends of the boot. The terminal assembly comprising a pin terminal, a pin terminal retainer and a coil compression spring. The pin terminal retainer includes a sleeve that is disposed in the terminal support tube and a forward latch tang that prevents withdrawal of the terminal assembly from the boot assembly. The pin terminal in the sleeve of the pin terminal retainer and an enlarged head that serves as the electrical contact that is pushed forwardly by the compression spring to engage the recessed contact of the spark plug assembly. The pin terminal retainer has a rearward latch tang that engages the pin terminal to limit the forward travel of the pin terminal and a ferrule that attaches the pin terminal retainer to an ignition cable.

4 Claims, 2 Drawing Sheets

70
68
32
38
56
42
36
52
48
40
50
46
12
54
44
34
27
39
26
45
24
14
10
30
20
23
28
22
18
16

SPARK PLUG CONNECTOR

BACKGROUND OF THE INVENTION

This invention relates generally to spark plug connectors and more specifically to sealed spark plug connectors for connecting ignition cables to spark plug terminals.

A sealed spark plug connector conventionally comprises a terminal that is attached to the end of an ignition cable and surrounded by an elastomeric boot that is attached to the end of the cable above the terminal. The terminal has a resilient receptacle which snaps onto a ball-like spark plug terminal post when the connector is pushed onto the spark plug providing a mechanical and an electrical connection between the two. When connected, the seal engages the spark plug insulator to provide a sealed environment for the electrical connection.

U.S. Pat. No. 2,904,769 granted to Lawrence R. Sampson et al, Sept. 15, 1959 and U.S. Pat. No. 3,359,526 granted to Roel Bakker, Dec. 19, 1967 exemplify these conventional arrangements which have been in use for many years.

A major disadvantage of such arrangements is that the engaged terminals provide the sole mechanical connection between the spark plug connector and the spark plug as well as the electrical connection between the two. Thus these arrangements require a strong mechanical connection and hence a high terminal engagement force requirement. The requirement for a strong mechanical connection also requires a strong crimp connection between the terminal and the ignition cable and a tensionally strong ignition cable because the spark plug connector is often pulled off the spark plug by pulling on the ignition cable.

It is also known to provide a sealed spark plug connector having a receptacle terminal that transfers disengagement forces to a relatively rigid plastic tube forming tube of the sealing arrangement. See U.S. Pat. No. 4,906,202 granted to Kenneth B. Germ Mar. 6, 1990 and assigned to the assignee of this invention. This arrangement alleviates the pull-off problem somewhat. However, the arrangement still has the disadvantage that the terminal connection provides the sole mechanical connection between the spark plug connector and the spark plug.

It is also known from U.S. Pat. No. 2,943,139 granted to Michael Skunda June 28, 1960 and U.S. Pat. No. 3,050,658 granted to Robert Lay et al Aug. 21, 1962 to provide an arrangement wherein the mechanical and electrical connections between the spark plug connector and the spark plug are separated. These arrangements, however, have several disadvantages. The mechanical connections are bulky and not suitable for modern engine designs such as multi-valve engines where the space available for the spark plug and spark plug connector is very limited. Another disadvantage is that the spark plug connectors are difficult to install.

SUMMARY OF THE INVENTION

The object of this invention is to provide an improved spark plug connector that makes separate mechanical and electrical connections with a spark plug.

Another object of this invention is to provide an improved spark plug connector of the above noted type that is compact enough for modern engines having four or even five valves per cylinder.

Still another object of this invention is to provide a compact spark plug connector that is easily installed on a spark plug that has a recessed terminal button.

Still yet another object of this invention is to provide a compact spark plug connector that has efficient sealing and improved dielectric performance when installed.

A feature of the invention is that it has a butt contact for making a non-mechanical electrical connection with the spark plug.

Another feature of the invention is that it has a structure for mechanically connection the spark plug connector to the engine which reduces the size requirements of the spark plug itself and the space it requires.

Still another feature of the invention is that it includes a relatively rigid thermoplastic boot that guides the connector terminal into engagement with a recessed spark plug terminal.

Yet another feature of the invention is that it includes a terminal assembly that includes a relatively rigid spring biased terminal contact that is mounted on a relatively rigid thermoplastic boot in such a way that it is easily guided into engagement with a recessed spark plug terminal.

Still yet another feature of the invention is that a secondary spark plug seal for increased sealing efficiency may be provided easily.

Still yet another feature of the invention is that spark plug and ignition cable seals can be provided easily by insert molding techniques.

Still yet another feature of the invention is that it provides a unique terminal assembly for use in spark plug connectors.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of the drawing.

DETAILED DESCRIPTION OF THE PREFERRED EMBODIMENT

Figure 1:
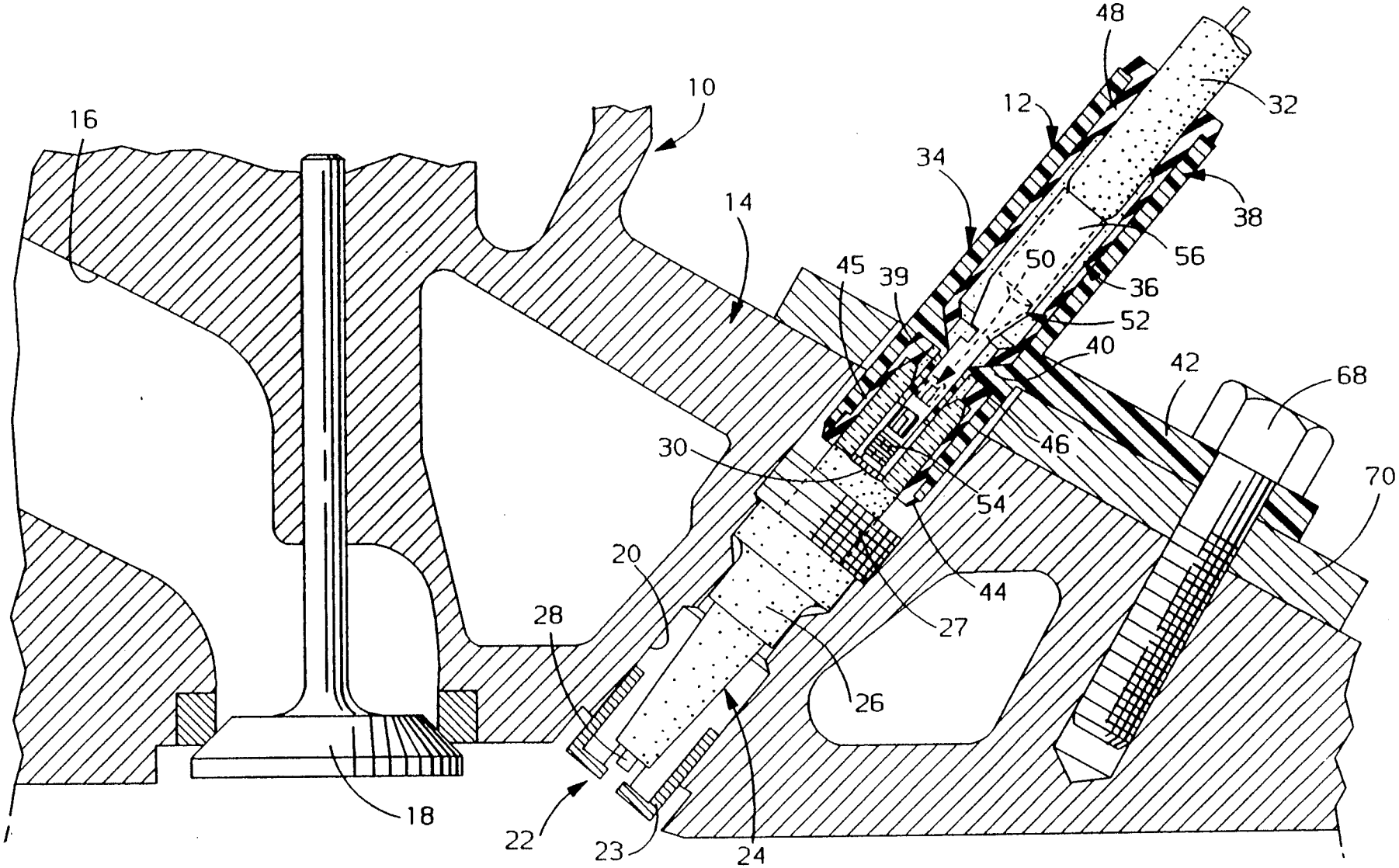
FIG. 1 is a fragmentary sectional view of an internal combustion, spark ignition engine having a spark plug connector in accordance with the invention.

Referring now to the drawing, FIG. 1 illustrates a fragmentary portion of an internal combustion, spark ignition engine 10 equipped with a spark plug connector 12 in accordance with our invention.

The engine 10 typically comprises a head 14 that is bolted to a cylinder block (not shown) and that includes intake and exhaust passages for each cylinder that are opened and closed by valves that are actuated by a cam shaft. FIG. 1 shows a typical passage 16 and valve 18 in the head 14 which also typically includes a spark plug bore 20 for each cylinder in which a spark plug 22 is mounted.

Modern engine designs often use four or even five valves per cylinder which limits the amount of space available for the spark plug 22 and the spark plug connector 12.

The spark plug 22 is designed to minimize its diameter and consequently it comprises a ground electrode 23 that is permanently attached to the head 14 at the inner end of the spark plug bore 20, and a replaceable center electrode assembly 24 that is mounted in the spark plug bore 20 to cooperate with the ground electrode 23 to provide the necessary gap for generating a spark for engine operation. This general arrangement is described in greater detail in U.S. patent application Ser. No. 07/513,498 filed by Keith Allen Penney et al Apr. 25, 1990 and assigned to the assignee of this invention.

The replaceable center electrode assembly 24 comprises a tubular insulator 26 that is retained in the spark plug bore 20 by a threaded retainer ring 27. The tubular insulator 26 houses a center electrode 28 that has an exposed firing tip. The upper end of the center electrode 28 is embedded in a conductive glass seal inside the insulator 26 (not shown). The center electrode assembly 24 further comprises a metal plug 30 that is also partially embedded in the conductive glass seal. The upper end of the metal plug 30 is disposed in the upper recess of the tubular insulator 26 to provide a terminal or contact button for connecting the spark plug 22 to an ignition cable 32 electrically via the spark plug connector 12 of this invention.

The spark plug connector 12 is made up of a boot assembly 34 and a terminal assembly 36. The boot assembly 34 includes an axially elongated tubular boot 38 of relatively rigid, high temperature thermoplastic material such as Rynite #530, a PET polyester material marketed by E. I. Dupont De Nemours & Co. Inc. of Wilmington, Delaware. The boot 38 has an internal terminal support tube 39 that is suspended by an internal annular flange 40. The boot 38 also includes an integral external arm 42 that has a bolt hole at the free end for securing the spark plug connector 12 to the engine head 14.

The boot assembly 34 further includes an elastomeric seal of silicone material having suitable fillers, catalysts and release agents for processing. The elastomeric seal is preferably inserted molded along the entire inner surface and inner portions of the end faces of the tubular boot 38 so that the elastomeric seal forms seals of substantial length at each end of the boot 38, i.e. a spark plug seal 44 at one end of the boot 38 and an ignition cable seal 48 at the other end. The spark plug seal 44 has a compression seal portion 45 that engages the outer circumferential wall of the insulator 26 to provide the primary spark plug seal. It also includes a face seal portion 46 supported by the flange 40 that engages the end face of the insulator 26. This provides a secondary seal and increased sealing efficiency at the spark plug. The annular flange 40 inside the boot 38 has a plurality of circumferentially spaced holes that permit the seal forming material to flow through the annular flange 40 to facilitate the insert molding operation.

Figure 2:
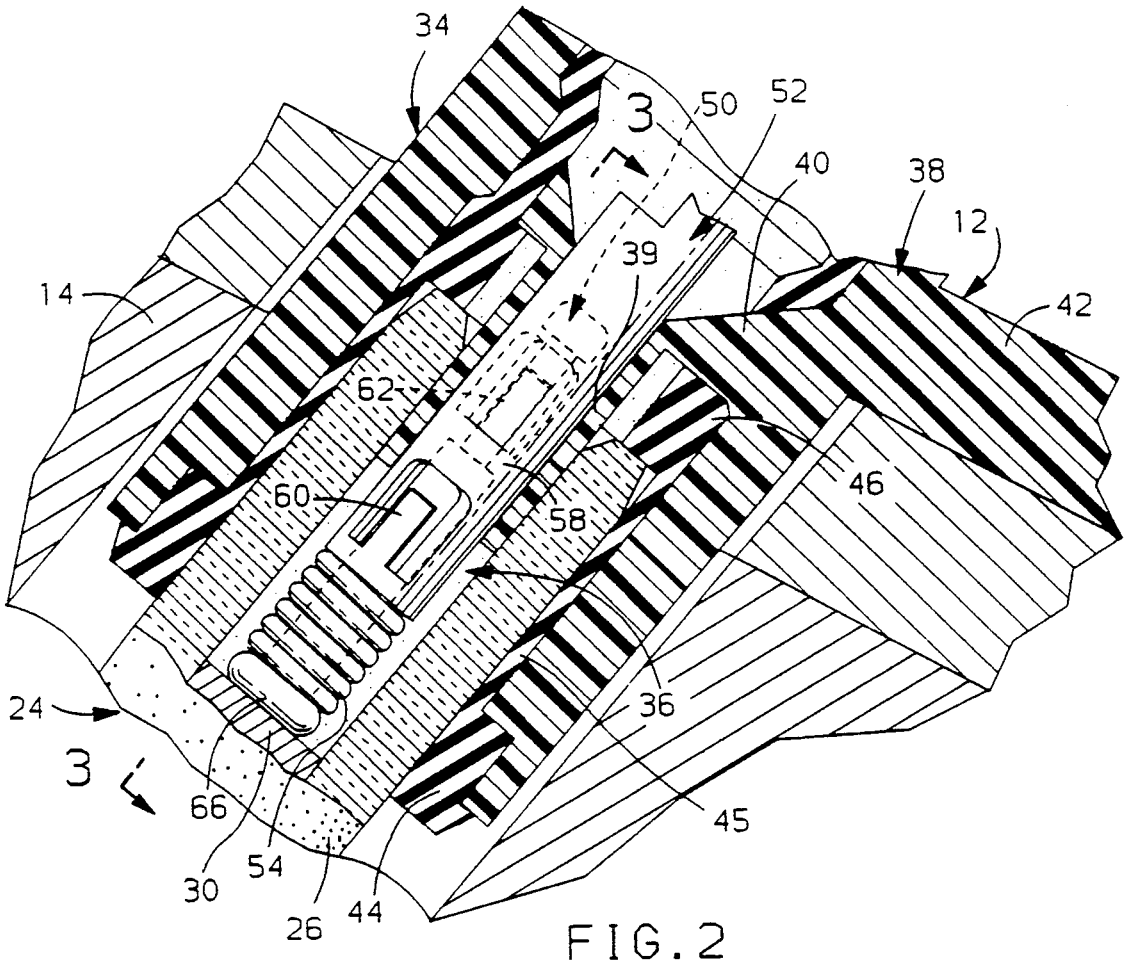
FIG. 2 is an enlargement of a portion of FIG. 1.
Figure 3:
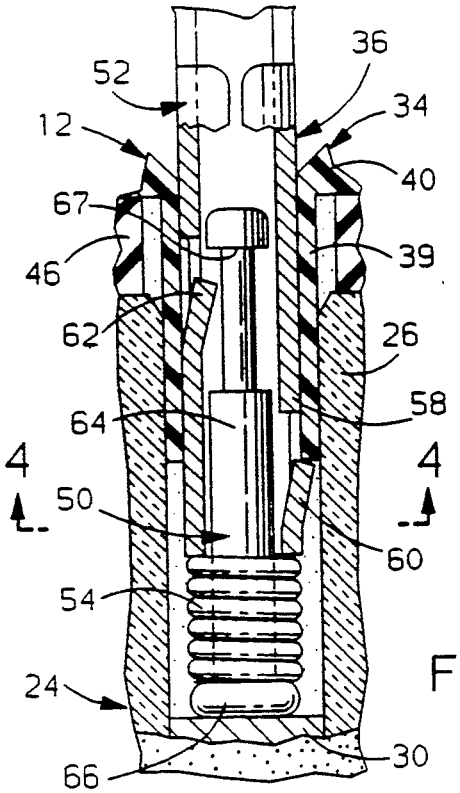
FIG. 3 is a section taken substantially along the line 3—3 of FIG. 2 looking in the direction of the arrows.
Figure 4:
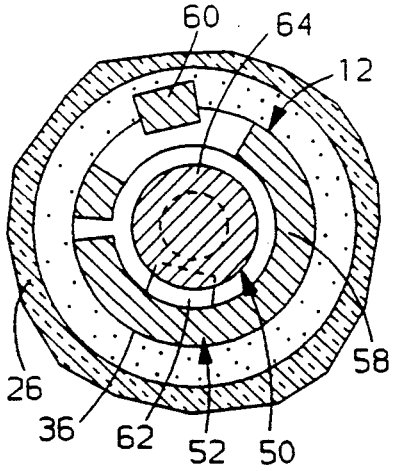
FIG. 4 is a section taken substantially along the line 4—4 of FIG. 3 looking in the direction of the arrows.

The terminal assembly 36 comprises a pin terminal 50, a pin terminal retainer 52, a coil compression spring 54 and a ferrule 56. The pin terminal retainer 52 includes a rolled sleeve 58 at the forward end that fits in the terminal support tube 39 of the boot 38 as best shown in FIGS. 2 and 3. Latch tangs 60 and 62 are lanced and bent out of the respective forward and rearward ends of the sleeve 58. The forward latch tang 60 is bent outwardly and engages the front face of the terminal support tube 39 to prevent withdrawal of the terminal assembly 36 from the boot assembly 34. The rearward latch tang 62 retains the pin terminal 50 in assembly with the pin terminal retainer 52 as explained below.

The pin terminal 50 has a cylindrical body 64 that slides in the rolled sleeve 58 of the pin terminal retainer 52 and an enlarged head 66 that serves as the electrical contact that butts against and engages the terminal or contact button 30 that is recessed in the end of the spark plug assembly 22. The coil spring 54 embraces the cylindrical body 64 of the pin terminal 50 engaging the enlarged head 66 at one end and the face of the rolled sleeve 58 at the other end so that the coil compression spring 54 pushes the pin terminal 50 forwardly of the sleeve 58 and into a butting type engagement with the contact button 30 of the spark plug 22. The forward travel of the pin terminal 50 is limited by the rearward tang 62 of the rolled sleeve 58 which extends inwardly into a groove in the rearward end of the body 64 and engages a shoulder 67. This also retains the pin terminal 50 in assembly with the pin terminal retainer 52.

As indicated above, the terminal assembly 36 includes a ferrule 56. This ferrule 56 is attached to the rearward end of the pin terminal retainer 52 and attaches it to the ignition cable 32 in a well known manner. See for instance U.S. Pat. No. 4,209,221 granted to John M. Chupak et al June 25, 1980 and assigned to the assignee of this invention.

The spark plug connector 12 is assembled in the following manner. The coil compression spring 54 is slid onto the rear end of the pin terminal 50 which is then inserted into the forward end of the sleeve 58 until the latch tang 62 snaps into the groove at the rear end of the pin terminal to form a sub-assembly. The ferrule 56 is attached to this sub-assembly and then crimped onto the ignition cable 32 attaching the entire terminal assembly 36 to the ignition cable 32. In actual practice, several sub-assemblies would be attached to a reel of ferrules which would then be crimped onto ignition cables in a continuous operation.

In any event, the terminal assembly 36 is then attached to the boot assembly 34 to provide the spark plug connector 12 simply by inserting the pin terminal retainer 52 into the terminal support tube 39 until the forward latch tang 60 snaps outwardly to engage the face of the terminal support tube 39. The boot assembly 34 is now assembled to the terminal assembly 36 and sealed around the ignition cable end 32 by the compression seal 48. The spark plug connector 12 formed in this manner is then connected to the spark plug 22 by inserting the forward end of the boot 38 into the spark plug bore 20. This guides the terminal support tube 39 and the pin terminal 50 into the upper recess of the spark plug 22 so that the pin terminal head 66 butt engages the recessed spark plug contact button 30 under the bias of the coil compression spring 54. The spark plug connector 12 is then fastened to the head 14 of the engine 10 by a bolt 68. In this particular instance a spacer plate 70 is used between the arm 42 and the head 14 to position the installed spark plug connector 12 properly. When the spark plug connector 12 is installed, the thermoplastic boot 34, support tube 39 and elastomeric spark plug seal 44 extend far down into the spark plug bore 20 so that the spark plug connector 12 provides improved dielectric performance as well as efficient sealing.

We wish it to be understood that we do not desire to be limited to the exact details of construction shown and described, for obvious modifications will occur to a person skilled in the art.

The embodiments of the invention in which an exclusive property or privilege is claimed are defined as follows:

1. A spark plug connector for connecting an ignition cable to a recessed contact button of a spark plug comprising;

a boot assembly and a terminal assembly, the boot assembly including an axially elongated tubular boot of relatively rigid, high temperature thermoplastic material, the boot having an internal terminal support tube that is suspended by an internal annular flange and at least one integral external arm that has a bolt hole at the free end for securing the spark plug connector to an engine head, the boot assembly further including an elastomeric seal of silicone material that is inserted molded along the entire inner surface and inner portions of the end faces of the tubular boot so that the elastomeric seal forms seals of substantial length at each end of the boot to provide primary and secondary spark plug seals at one end of the boot and an ignition cable seal at the other end, the annular flange outside the boot having a plurality of circumferentially spaced holes that permit the seal forming material to flow through the annular flange to facilitate the insert molding operation, the terminal assembly comprising a pin terminal, a pin terminal retainer, a coil compression spring and a ferrule, the pin terminal retainer including a rolled sleeve at a forward end that is disposed in the terminal support tube of the boot and latch tangs that are lanced and bent out of the respective forward and rearward ends of the sleeve, the forward latch tang being bent outwardly and engageable with a front face of the terminal support tube to prevent withdrawal of the terminal assembly from the boot assembly, the pin terminal having a cylindrical body that slides in the rolled sleeve of the pin terminal retainer and an enlarged head that serves as an electrical contact for butt engaging the recessed contact button of the spark plug assembly, the coil compression spring embracing the cylindrical body of the pin terminal and engaging the enlarged head at one end and the face of the rolled sleeve at the other end so that the coil compression spring pushes the pin terminal forwardly of the sleeve for butt engagement with the recessed contact button of the spark plug, the forward travel of the pin terminal being limited by the rearward tang of the rolled sleeve which extends inwardly into a groove in the rearward end of the body and engages a shoulder at the rearward end of the groove which also retains the pin terminal in assembly with the pin terminal retainer, and the ferrule being attached to the rearward end of the pin terminal retainer for attaching it to the ignition cable.

2. A spark plug connector for connecting an ignition cable to a recessed contact of a spark plug comprising;

a boot assembly and a terminal assembly, the boot assembly including an axially elongated tubular boot of relatively rigid thermoplastic material that has an internal suspended terminal support tube and means for securing the spark plug connector to an engine head, the boot assembly further including an elastomeric seal that extends along an inner surface of the tubular boot from a front end of the tubular boot to a location rearwardly of a front face of the terminal supporting tube to provide a spark plug seal at the front end of the boot, the terminal assembly comprising a pin terminal, a pin terminal retainer and a coil compression spring, the pin terminal retainer including a sleeve at a forward end that is disposed in the terminal support tube of the boot and latch tangs that are lanced and bent out of the respective forward and rearward ends of the sleeve, the forward latch tang being bent outwardly and engageable with the front face of the terminal support tube to prevent withdrawal of the terminal assembly from the boot assembly, the pin terminal having a body that slides in the sleeve of the pin terminal retainer and an enlarged head that serves as the electrical contact for engaging the recessed contact of the spark plug assembly, the coil compression spring engaging the enlarged head of the pin terminal at one end and the sleeve at the other end so that the coil compression spring pushes the pin terminal forwardly of the sleeve for engagement with the recessed contact of the spark plug, the forward travel of the pin terminal being limited by the rearward tang of the rolled sleeve which extends inwardly to engage a rearward shoulder of the pin terminal, and means for attaching the pin terminal retainer to an ignition cable.

3. A spark plug connector for connecting an ignition cable to a recessed contact of a spark plug comprising;

a boot assembly and a terminal assembly, the boot assembly including an axially elongated tubular boot of relatively rigid thermoplastic material that has an internal terminal support and an internal elastomeric compression seal spaced rearwardly of a front face of the terminal support to provide a spark plug seal at the front end of the boot, the terminal assembly comprising a pin terminal, a pin terminal retainer and a compression spring, the pin terminal retainer including a sleeve at a forward end that is disposed in the terminal support of the boot and means engageable with the terminal support to prevent withdrawal of the terminal assembly from the boot assembly, the pin terminal having a body that slides in the sleeve of the pin terminal retainer and an enlarged head that serves as the electrical contact for engaging the recessed contact of the spark plug assembly, the compression spring engaging the enlarged head of the pin terminal at one end and the sleeve at the other end so that the compression spring pushes the pin terminal forwardly of the sleeve for engagement with the recessed contact of the spark plug, and the pin terminal retainer including further means engageable with the pin terminal to limit forward travel of the pin terminal and ferrule means for attaching the pin terminal retainer to an ignition cable.

4. A terminal assembly for spark plug connector comprising an ignition cable to a recessed contact of a spark plug comprising;

a pin terminal, a pin terminal retainer and a coil compression spring, the pin terminal retainer including a sleeve at a forward end and latch tangs that are lanced and bent out of the respective forward and rearward ends of the sleeve, the forward latch tang being bent outwardly and engageable with a front face of a terminal support to prevent withdrawal of the terminal assembly from the support, the pin terminal having a body that slides in the sleeve of the pin terminal retainer and an enlarged head that serves as an electrical contact for engaging a contact of a spark plug, the coil compression spring engaging the enlarged head of the pin terminal at one end and the sleeve at the other end so that the coil compression spring pushes the pin terminal forwardly of the sleeve for engagement with the recessed contact of the spark plug, the forward travel of the pin terminal being limited by the rearward tang of the roller sleeve which extends inwardly to engage a rearward shoulder of the pin terminal, and means for attaching the pin terminal retainer to an ignition cable.

* * * * *